US006676463B2

(12) United States Patent
Le Bert et al.

(10) Patent No.: US 6,676,463 B2
(45) Date of Patent: Jan. 13, 2004

(54) DEVICE FOR REDUCING NOISE AND ABSORBING VIBRATIONS GENERATED BY AN ELECTRIC MOTOR BUILT INTO A SHIP PROPULSION POD

(75) Inventors: Jean-Francois Le Bert, Nantes (FR); Richard Barbarin, Vertou (FR)

(73) Assignee: Etat Francais Represente Par le Delegue General pour l'Armement, Cedex (FR)

( * ) Notice: Subject to any disclaimer, the term of this patent is extended or adjusted under 35 U.S.C. 154(b) by 0 days.

(21) Appl. No.: 10/149,377

(22) PCT Filed: Oct. 11, 2001

(86) PCT No.: PCT/FR01/03138

§ 371 (c)(1),
(2), (4) Date: Jul. 18, 2002

(87) PCT Pub. No.: WO02/30742

PCT Pub. Date: Apr. 18, 2002

(65) Prior Publication Data

US 2003/0054705 A1 Mar. 20, 2003

(30) Foreign Application Priority Data

Oct. 12, 2000 (FR) ..... 00 13044

(51) Int. Cl.[7] ..... B60L 11/02
(52) U.S. Cl. ..... 440/6; 114/269

(58) Field of Search ..... 440/6; 114/269

(56) References Cited

U.S. PATENT DOCUMENTS 6,116,179 A 9/2000 Swinbanks et al.
6,192,821 B1 * 2/2001 Morales et al. ..... 114/343

FOREIGN PATENT DOCUMENTS

| | | |
|---|---|---|
| EP | 0533359 | 3/1993 |
| EP | 0590867 | 4/1994 |
| EP | 1010614 | 6/2000 |
| WO | WO 97/49605 | 12/1997 |
| WO | WO 99/05023 | 2/1999 |
| WO | WO 99/05024 | 2/1999 |
| WO | WO 99/36312 | 7/1999 |

* cited by examiner

*Primary Examiner*—Jesus D. Sotelo
(74) *Attorney, Agent, or Firm*—Oliff & Berridge, PLC

(57) ABSTRACT

An absorption device absorbs vibrations generated by an electric motor that is built into a propulsion pod of a ship. The propulsion pod contains an electric motor that is cooled by circulation of a radial airflow within the propulsion pod. The electric motor rotationally drives at least one propeller through a transmission shaft. The absorption device is disposed in the propulsion pod to position and hold the electric motor inside the propulsion pod and also to filter the vibrations emitted by the motor and channel the motor cooling airflow circulation.

10 Claims, 5 Drawing Sheets

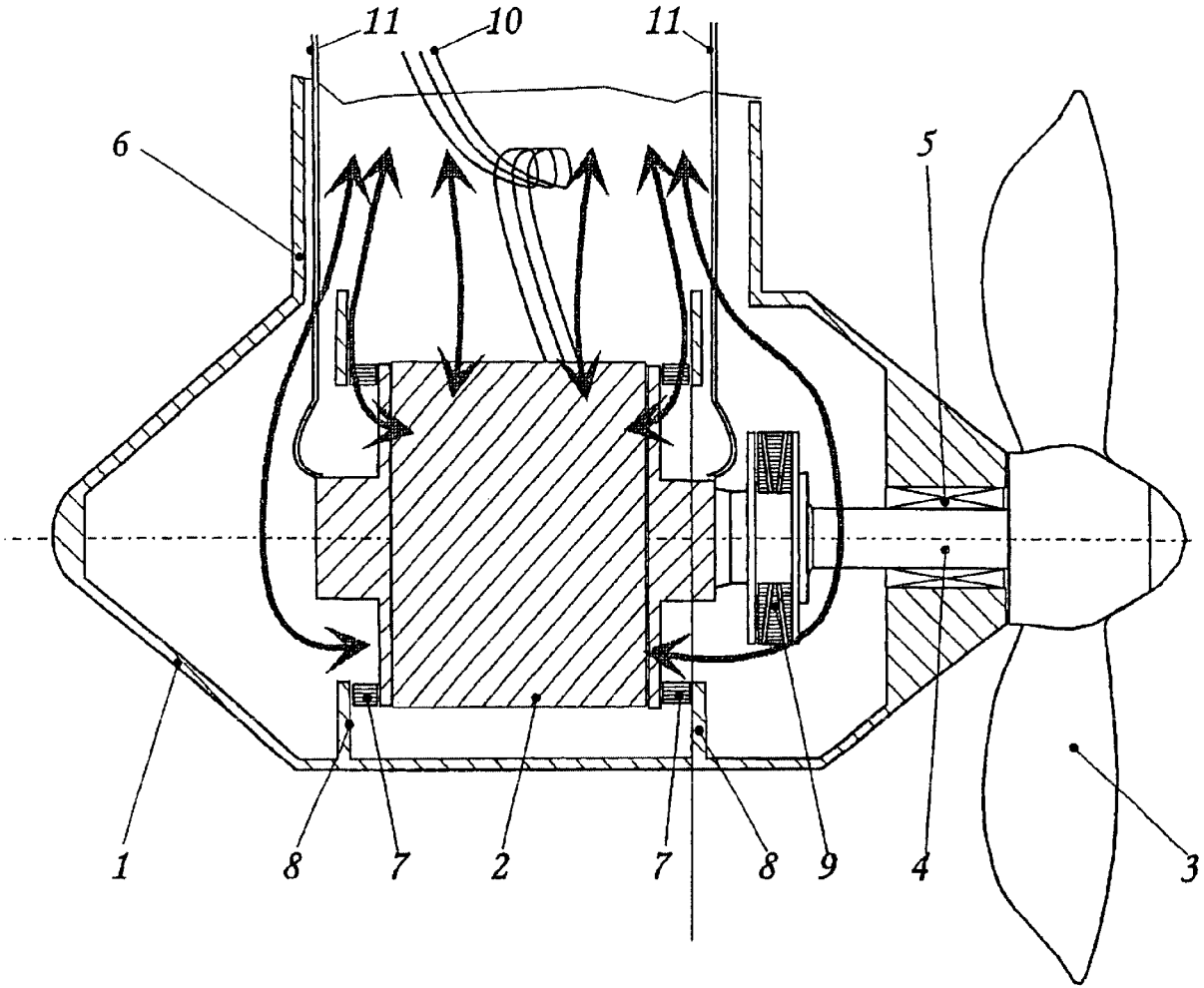
- Figure 1 -

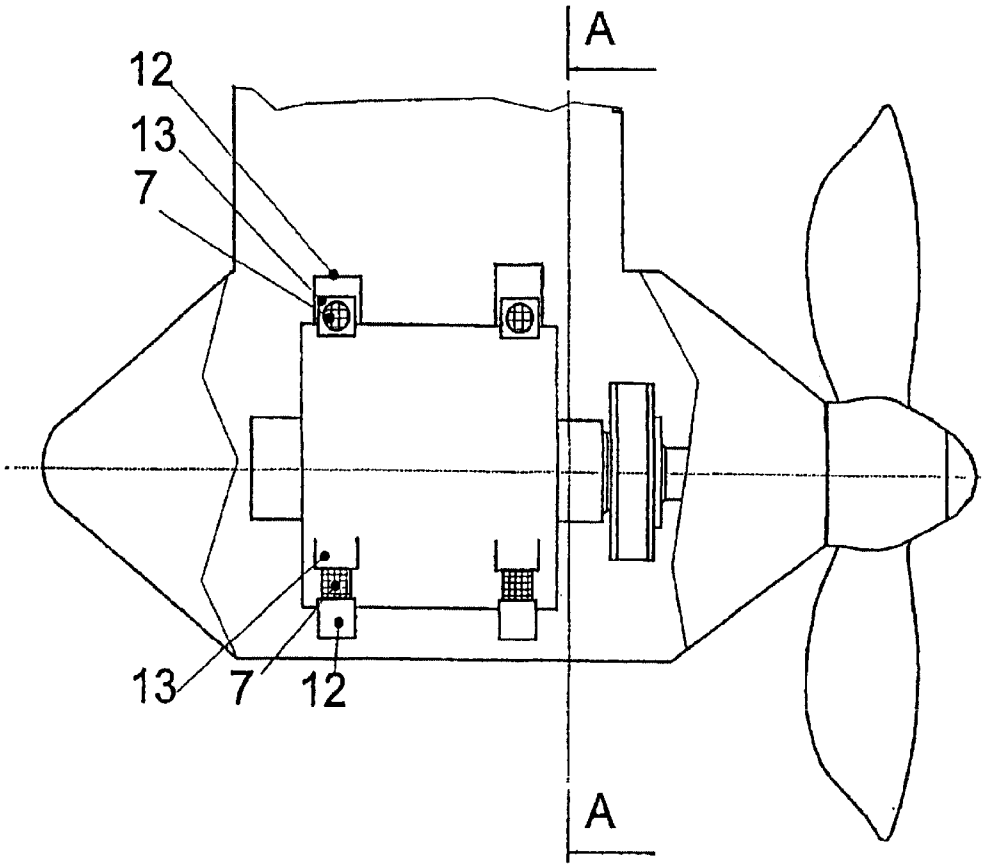
- Figure 2 -
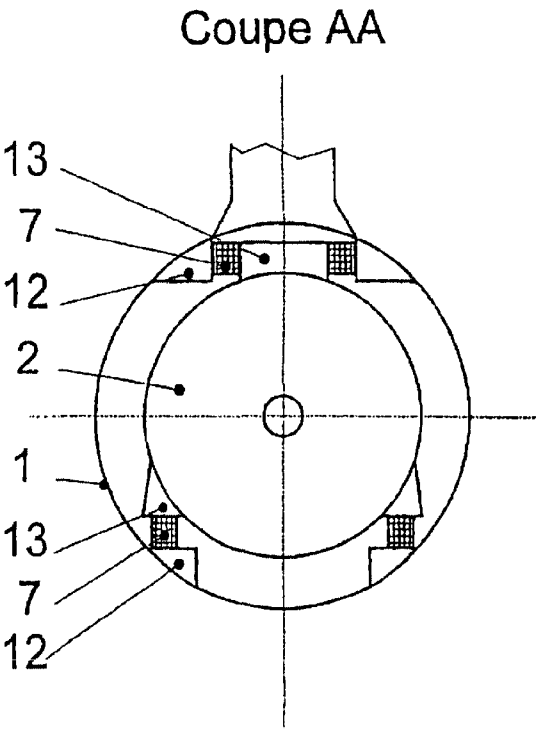
- Figure 2A -

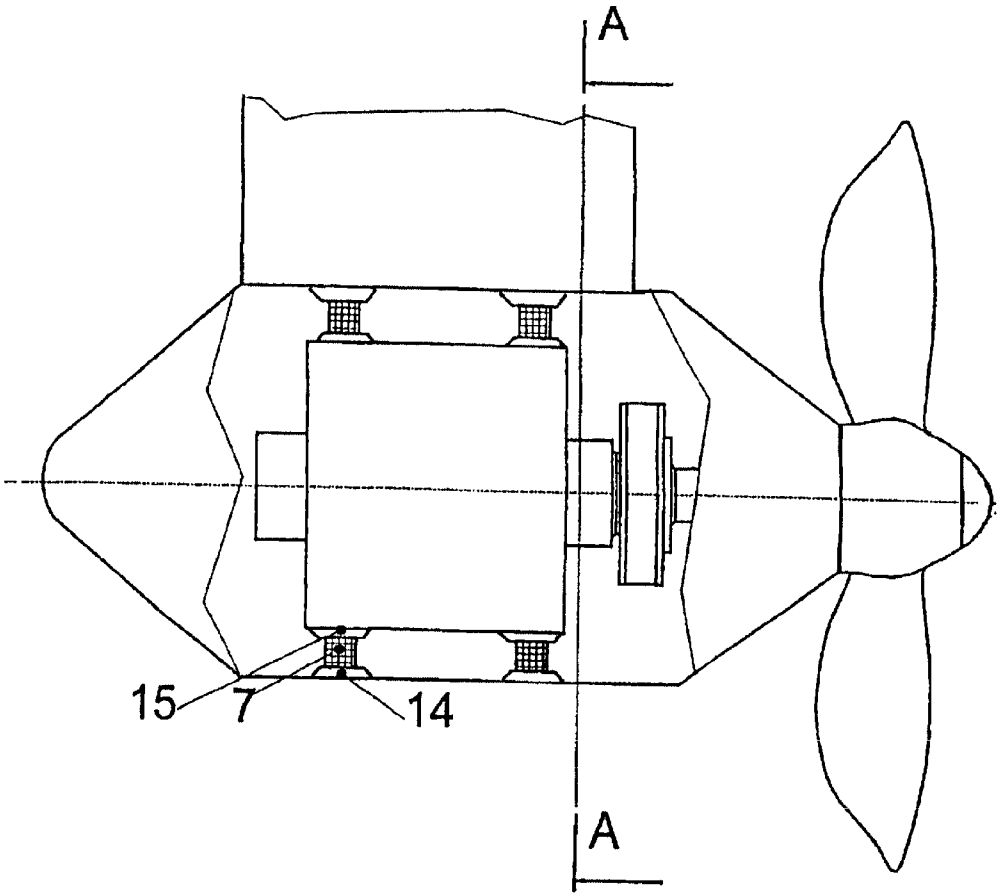
- Figure 3 -
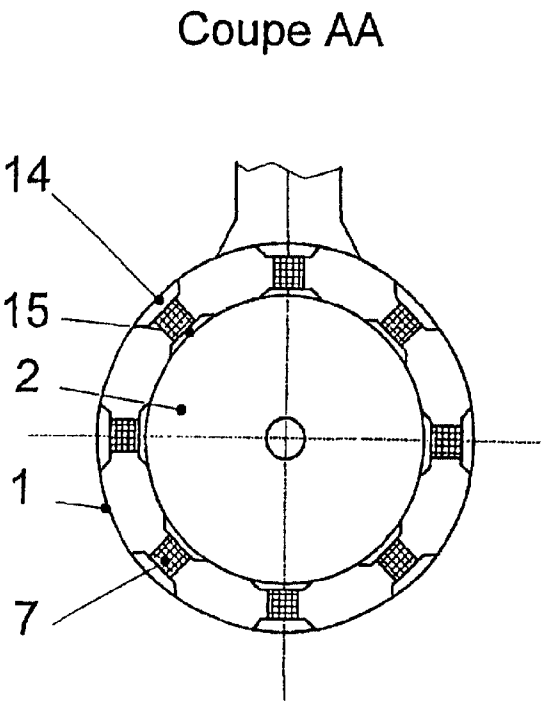
- Figure 3A -

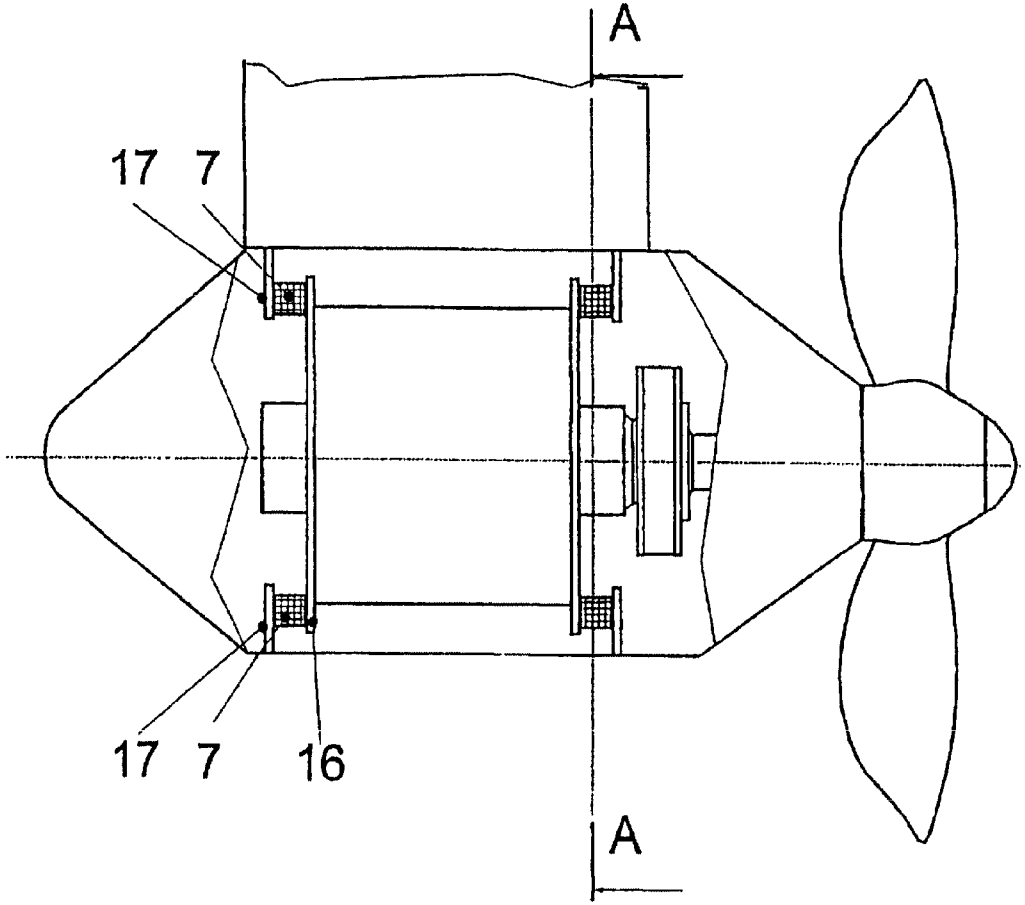
- Figure 4 -
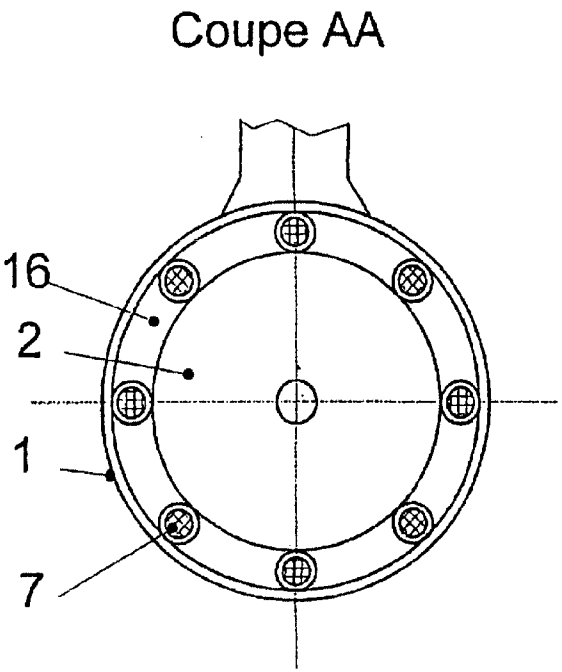
- Figure 4A -

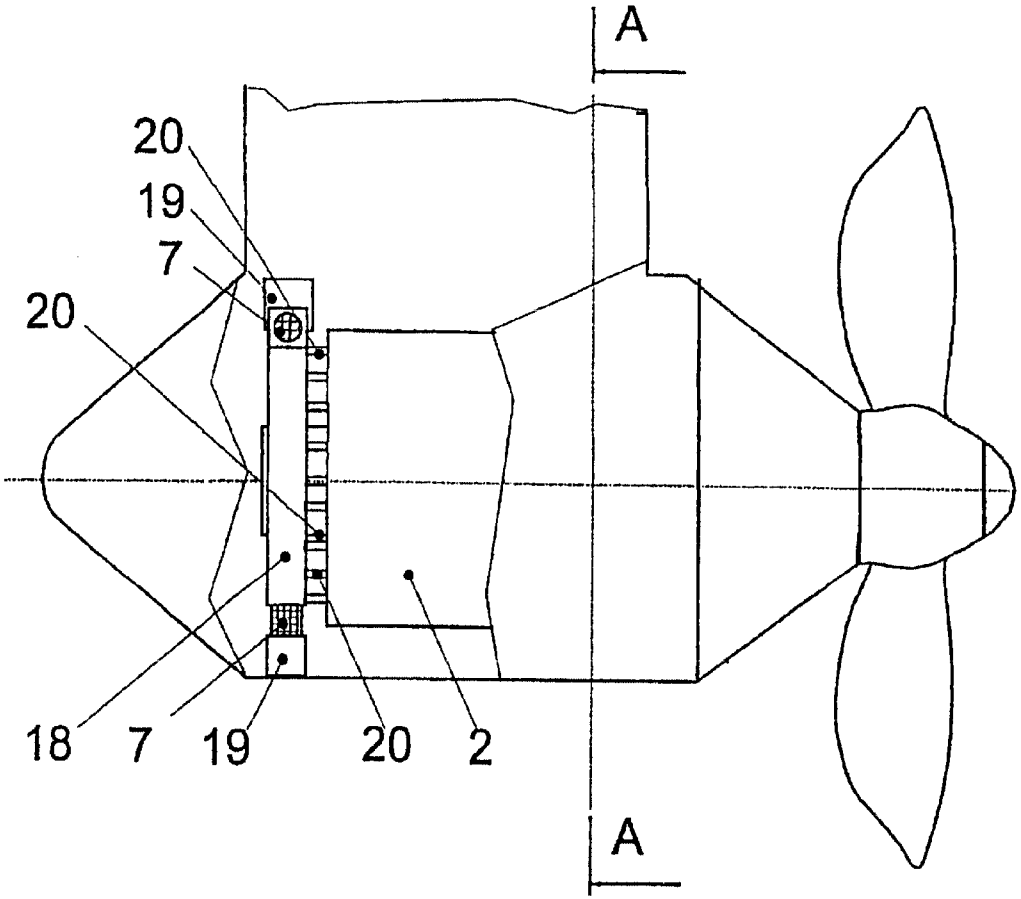
- Figure 5 -
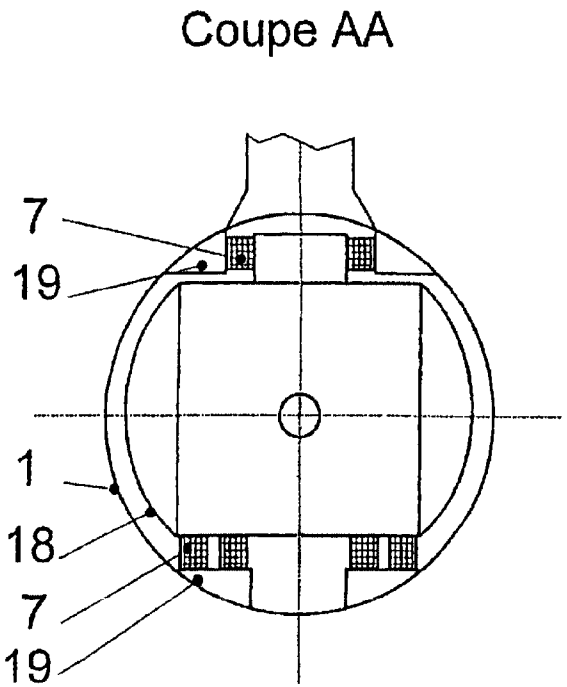
- Figure 5A -

DEVICE FOR REDUCING NOISE AND ABSORBING VIBRATIONS GENERATED BY AN ELECTRIC MOTOR BUILT INTO A SHIP PROPULSION POD

BACKGROUND OF THE INVENTION

1. Field of Invention

This invention relates to devices for reducing noise and absorbing vibrations generated by an electric motor built into the propulsion pod of a ship.

2. Description of Related Art

Surface shipping is propelled in various ways, including in particular: mechanical or electrical propulsion, known as classical propulsion, comprising one or more lines of shafts inside the hull with one or more propellers at the ends and one or more rudders physically independent of the propulsion system; and pod propulsion wherein one or more electric motors associated with one or more lines of shafts are built into a fixed or swiveling pod outside the hull of the ship, with the pod thus acting as an active rudder since it is able to rotate relative to the hull. The first industrial developments of this electric pod propulsion method are very recent, dating back only about ten years. This system, also known to specialists by the English term "pod", is a significant breakthrough for propulsion of passenger liners, icebreakers, and other ships. It is of great interest in the navy and merchant navy as it relates to electric propulsion applications and to applications replacing certain mechanical applications.

This electric propulsion system for ships is highly maneuverable and has good dynamic performance. Its motor, placed inside a submerged pod that pivots 360°, is coupled directly to a very short propeller shaft. Such a propulsion system can develop powers as high as 25 MW. In this technical area, several reductions to practice have already been proposed. Pod type propulsion systems for ships comprised in particular of a swiveling pod containing an electric motor driving one or more propellers rotationally through a shaft are known in the art.

SUMMARY OF THE INVENTION

For currently known pods, the electric motor is generally mounted rigidly in the pod, particularly by shrink fitting or crimping. This type of mount allows some of the heat given off by the electric motor to be evacuated by conduction between the body of the pod and the surrounding seawater. The motor is also cooled by a cooling circuit and/or by ventilation as described for example in international patent applications PCT WO 97/49605, WO 99/05023, WO 99/05024, and WO 99/36312.

Such a mount for the electric motor in the pod has a major drawback linked to propagation of vibration and noise emitted by the electric motor. This mount is favorable to cool the motor by creating a heat bridge between the motor, which heats up, and the water surrounding the pod. However, at the same time it creates a sound bridge between the motor, which is also a significant noise source, and the outer envelope of the pod which radiates into the surrounding water and transmits vibrations to the ship structure. Hence it is highly unfavorable from the acoustic detectability standpoint. because these vibrations are transmitted directly to the pod without attenuation and can thus propagate in seawater, or toward the hull of the ship through the arm linking the pod to the ship. In fact, the electric motors of all the pods currently on the market are rigidly mounted in the pod and often crimped, precisely to favor heat exchange with the surrounding water, thus reducing the need for other cooling means.

Several designs for large second-rank naval vessels are currently planned. The principal navies of the world are also looking at the possibility of providing some frigates with this electric pod propulsion method. The particular and highly useful application of pod propulsion on naval vessels imposes acoustic detectability requirements that cannot be met by existing pods, due in particular to the type of electric motor mount in the pod normally found in these propulsion systems.

The advertising of pod manufacturers boasts of the silent nature of this type of propulsion. This argument is also taken up by some of their customers, such as shipyards that build passenger liners. This point requires clarification. One of the intrinsic features of pods is that the propeller can be located forward of the pod and thus act as a driving propeller in a relatively undisturbed hydrodynamic flow, as there is no impediment to flow in front of it. On the other hand, a classical push propeller attached behind a line of shafts exiting rearward from a hull encounters a highly perturbed flow. Because of this favorable arrangement of the propeller, the pressure fluctuations on each propeller blade when the propeller rotates are minimal and consequently transmit only very small pressure forces to the parts of the ship's bottom near the propeller. Since these pressure impacts generate noise on the structure on the ship, the pod appears by nature to be favorable to a reduction in noise of hydrodynamic origin in the ship.

Patent EP 1010614 describes a pod for a surface vessel having in particular an electric motor cooled by a liquid carried in a circuit connected to a heat exchanger located in one end of the pod. The stator of the motor is mounted on an elastic element to damp vibrations generated by the motor. The heat exchanger plus the cooling circuit placed around the motor take up a great deal of space inside the pod so that there is no room for air circulation around the motor. Moreover, no details are given as to the arrangement of the elastic element, which is connected only to the stator of the motor.

U.S. Pat. No. 6,116,179 teaches the mounting of machinery inside a ship using levitation means comprised of electromagnetic devices located between the machinery and the hull of the ship. By varying the electromagnetic forces, contact-less centering and holding of the machinery in the hull are achieved. These forces are also controlled to reduce the noise radiated by the hull. This arrangement requires electromagnetic isolation of these devices from the perturbations emitted by the machinery, thus forming a shielded enclosure that does not allow sufficient radial air circulation between the machinery and the hull. Moreover, maintenance of the machinery with the contact-less electromagnetic devices is a complex technique that is difficult to master.

Patent EP 0533359 describes an electric motor for driving a ship. This is a disc motor with permanent magnets and a large number of small converters located on the front and rear faces of the motor, an elastic coupling attached to the rotor, and means for controlling the converters associated with a particular internal motor design to reduce noise. The motor is mounted on sound insulators by lugs attached to the outer surface of the motor frame. The motor is cooled by fluid circulating in the stator. Converters located on the front and rear faces of the motor are cooled by cold water circulation plates. Because of manufacturing constraints for disc motors, passage cross-sections large enough for an air flow ensuring good motor cooling cannot be provided.

The goal of the present invention is to overcome the above-described drawbacks by providing a device capable of absorbing a sufficient portion of the vibrations generated by operation of the electric motor to meet the acoustic detectability requirements (noise radiated into the water) of the vessel and its propulsion system imposed on naval vessels. Another goal of the invention is to ensure continuous, highly stable physical maintenance of the motor in the pod without creating an impediment to circulation of the cooling air used to cool the motor. The present invention also has the goal of improving acoustic comfort on board the ship. Another goal is to reduce transmission of airborne noise from the motor to the pod without increasing the pod diameter, which would adversely affect the efficiency and noise of the propeller. Hence, the goal of the invention is to reduce the noise level emitted by the electric motors of the pods, whether toward the vessel itself or into the environment.

For this purpose, the invention relates to a device for absorbing vibrations generated by an electric motor built into a propulsion pod of a ship. The motor is cooled by the circulation of radial air flow in the pod and drives rotationally at least one propeller through a transmission shaft. The device is disposed in the pod to position and hold the motor inside the pod, filter the vibrations emitted by the motor, and channel the motor-cooling air flow circulation.

In one exemplary embodiment, the means are comprised of decoupling studs located between the motor and the interior wall of the pod. In another exemplary embodiment, each decoupling stud is attached to a first element attaching to the motor and to a second element attaching to the inside wall of the pod. The decoupling studs may be made of elements that are active and/or passive relative to the vibrations of motor. The decoupling studs may also be oriented in two essentially perpendicular directions or may be radially symmetrical relative to the axis of the motor. The first element attaching the motor to the decoupling stud is comprised of a mounting lug or a brace or directly by the motor flange. The second element attaching the decoupling stud to the interior wall of the pod is comprised of a mounting lug or a brace. Preferably, the electric motor is connected to the transmission shaft through an elastic coupling.

This device has the advantage of providing a particularly quiet electric propulsion pod whose outer shape and propulsion capabilities are unchanged relative to existing systems. Another advantage resides in the quality of the motor stability inside the pod, associated with optimized cooling air circulation over all the various faces of the motor.

It is important for certain vessels to reduce the noise level or vibration level on board for the comfort of the passengers and crew, and to facilitate on-board work. It is just as important to reduce the noise level transmitted to the environment. This applies to airborne noise transmission in order not to inconvenience populations in the vicinity of ports and canals. It also applies to transmission into the marine environment. The noise from a ship can propagate over very long distances at sea. It is a major source of indiscretion for a military vessel, can seriously interfere with measurements by scientific, oceanographic, or geophysical research vessels, and may have a non-negligible effect on numerous marine animals by interfering with the acoustic signals they emit or pick up for direction-finding or recognition of other animals.

Other features and advantages of the invention are described in or are apparent from the following detailed description of the preferred embodiments.

BRIEF DESCRIPTION OF THE DRAWINGS

Various exemplary embodiments of the invention will be described with reference to the accompanied drawings, in which like elements are labeled with like numbers and in which:

FIG. 1 is a lengthwise sectional view of a pod equipped with a device according to the present invention;

FIG. 2 is a view according to FIG. 1, showing a first variant embodiment of the device with studs oriented in two different directions;

FIG. 2A is a cross section along line AA in FIG. 2;

FIG. 3 is a view according to FIG. 1 showing a second embodiment of the device with studs disposed radially;

FIG. 3A is a cross section along line AA in FIG. 3;

FIG. 4 is a view according to FIG. 1 showing a third embodiment of the device with studs disposed on attachments distributed inside the pod;

FIG. 4A is a cross-sectional view along line AA in FIG. 4;

FIG. 5 is a view according to FIG. 1 showing a fourth embodiment of the device with studs associated with an intermediate support; and FIG. 5A is a cross-sectional view along line AA in FIG. 5.

DETAILED DESCRIPTION OF PREFERRED EMBODIMENTS

FIGS. 1 to 5 show, in a streamlined pod 1, an electric motor 2 substantially coaxial with the pod and driving a propeller 3 with the aid of a transmission shaft 4. The function of centering and holding the transmission shaft in the pod and the function of transmitting thrust from the propeller to the pod are carried out by one or more sets of mechanical parts (bearings, rollers, stop, or thrust bearing) of a known type shown at 5. In general, the pod is suspended under the hull of the vessel to be driven, by means of a linking arm 6, located on the upper part of the pod, which also provides for passage of the various circuits and requirements needed for propulsion operation. These are the motor power cables 10, ventilation of the pod, and fluid or electrical links 11 for operation and control of the motor and of the equipment in the pod, and also for safety functions.

Ventilation means (not shown) drive an air flow channeled by linking arm 6 into the interior of pod 1. This air flow, shown by arrows in FIG. 1, penetrates through the front and rear faces, circulates between the rotor and the stator and through the stator, and exits radially at the outer cylindrical face of the stator. This radial arrangement of motor-cooling air circulation is highly preferable to simple axial air circulation. In axial circulation, the air entering at one end of the motor circulates between the rotor and the stator and exits at the other end. Radial circulation ensures good homogenization of temperatures and prevents hot spots, thus increasing the motor power density and considerably increasing motor service life.

The motor is mounted in the pod by decoupling studs 7 attached to the strong motor frame and the strong pod structure at appropriate points. These studs can be attached directly or through mechanical links 8, 12, 13, 14, 15, 16, and 17. The link between the transmission shaft and the propeller is through an electric coupling 9 of a known type. The power cables 10 supplying the motor with electricity have flexible cable runs. The other electric and fluid connections 11 to the motor are also flexible (flexible runs for the cables; hoses or sleeves for the fluid circuits).

The incoming and outgoing ventilation air flows are separated by material elements (not shown) of a known type such as ducts in the linking arm 6 and flexible bellows between the motor flanges and ducts or the wall of the pod.

The pod is generally suspended under the bottom of the vessel by arm 6 and can be fixed or swiveling. It can also be built into the keel of the ship. The pod can also have two propellers 3, one at each end, these propellers being drivable by the same motor 2, which is then connected at the shaft ends by two elastic couplings 9 providing the link to the two transmission shafts 4 to the propellers. The two propellers can also be driven by two independent electric motors 2 each mounted similarly, whether the propellers are counter-rotating or rotate in the same direction.

The simplest method of attaching the studs is to attach them directly to the motor frame and the structure of the pod, which requires relatively simple means (braces 12, 13, 14, and 15, mounting lugs 8 and 17, or small supports welded on or mounted mechanically). This arrangement can sometimes require oversizing (any increase in pod size is in particular prejudicial to hydrodynamic performance) or present geometric difficulties of connection between the areas of the motor and pod that have adequate structural strength. In this case, intermediate supports 13, 15, and 16 should be used in continuity with the motor frame, on which it is easy to attach studs 7. Advantageously, these intermediate supports can be disposed on the front and rear faces of the motor, and designed such that they do not impede circulation of the motor-cooling air flow (design consisting of strips of sheet metal welded together, for example). These supports are rigidly attached to the motor frame, either directly on flanges 16 or on the shell when one is present, or connected to flanges 16 by tie rods or flat bars. This arrangement also enables sufficient space to be left for circulation of cooling air.

The arrangement of the studs in the lengthwise direction, in order to balance and control stresses, is generally done in successive planes perpendicular to the axis. The simplest arrangement is in two planes each near one of the two faces of the motor. An effort should be made to arrange the studs in transverse planes so that the position of the motor, which is generally cylindrical, in the pod, which is cylindrical or streamlined and substantially coaxial with the motor, can be controlled at the same time as providing decoupling functions.

Two alternative stud arrangements are proposed. The first is a composition of studs oriented in at least two directions (in the case of two directions, with a significant angle, 90° if possible, between them) so that the stresses can be taken up efficiently and the vibrations can be filtered in the entire transverse plane. The simplest arrangement in the case of two directions is for the directions to be vertical and horizontal, the vertically oriented studs being additionally chosen to continuously take the weight of the motor (FIG. 2). The second variant relates to a composition of studs oriented radially with respect to the motor axis. The good symmetry of this arrangement enables the vibrations to be effectively filtered in all directions. The studs at the lower part are then chosen to additionally take the weight of the motor continuously (FIG. 3).

All the arrangements for mounting and connecting the electric motor in the pod are designed to reduce propagation of motor vibrations and noises to the surrounding structures (the structure of the pod, the propeller, the linking arm, and the hull of the vessel). These arrangements are also designed to ensure precise positioning of the motor relative to the pod structure by limiting play, and play between the motor shaft and the propeller shaft, under all operating conditions and whatever the movements and accelerations to which the vessel and the pod are subjected (particularly movements due to ocean swell, explosion shocks, and motor power or speed transients). The decoupling studs thus provide motor holding and positioning functions while filtering vibrations and minimizing hindrance to the motor-cooling air flow.

The various arrangements of decoupling studs described above do not impede the circulation of cooling air. This is because these studs, in these arrangements, leave the incoming and outgoing air cross sections entirely clear enabling all the elements of which the electric motor is made to be properly cooled. Optimization of decoupling according to the motor characteristics and excitation frequencies, depends on the type of studs, with an elastic or viscoelastic passive function (rubber, metal/rubber, metal coil or cable, damper, etc.), or active function (vibrator controlled by motor behavior, etc.). These studs are characterized in particular by their rigidity and damping coefficients and their directional or multidirectional nature, the number, position, and orientation of the studs and the attachments of the studs on the pod side and the motor side (interface supports, etc.).

What is claimed is:

1. An absorption device for absorbing vibrations generated by an electric motor built into a propulsion pod of a ship, wherein the electric motor is cooled by circulation of a radial air flow in the propulsion pod and rotationally drives at least one propeller through a transmission shaft, and wherein the absorption device is disposed in the propulsion pod to position and hold the electric motor inside the propulsion pod to filter the vibrations emitted by the motor, and channel the motor-cooling air flow circulation.

2. The absorption device according to claim 1, wherein the absorption device is comprised of decoupling studs disposed between the electric motor and an interior wall of the propulsion pod.

3. The absorption device according to claim 2, wherein each decoupling stud is attached to a first element attached to the electric motor and to a second element attached to the interior wall of the propulsion pod.

4. The absorption device according to claim 3, wherein the decoupling studs are made of elements that are one of active and passive relative to the vibrations of the electric motor.

5. The absorption device according to claim 4, wherein the decoupling studs are oriented in two essentially perpendicular directions.

6. The absorption device according to claim 4, wherein the decoupling studs are radially symmetrical relative to an axis of the electric motor.

7. The absorption device according to claim 3, wherein the first element attached to the electric motor and to the decoupling stud is comprised of at least one of a mounting lug and a brace.

8. The absorption device according to claim 3, wherein the decoupling stud is connected directly to a motor flange.

9. The absorption device according to claim 3, wherein the second element attached to the decoupling stud and to the interior wall of the electric pod is comprised of at least one of a mounting lug and a brace.

10. The absorption device according to claim 1, wherein the electric motor is connected to the transmission shaft through an elastic coupling.

* * * * *